US012570333B2

(12) United States Patent
Josephson et al.

(10) Patent No.: US 12,570,333 B2
(45) Date of Patent: Mar. 10, 2026

(54) COVERED HOPPER RAILCAR

(71) Applicant: JAC Operations, Inc., Chicago, IL (US)

(72) Inventors: Gregory P. Josephson, Salix, PA (US); Joseph Johns, Nanty Glo, PA (US); Daniel Militaru, Sarasota, FL (US)

(73) Assignee: JAC Operations, Inc., Chicago, IL (US)

( * ) Notice: Subject to any disclaimer, the term of this patent is extended or adjusted under 35 U.S.C. 154(b) by 906 days.

(21) Appl. No.: 17/735,988

(22) Filed: May 3, 2022

(65) Prior Publication Data

US 2022/0371628 A1 Nov. 24, 2022

Related U.S. Application Data

(60) Provisional application No. 63/183,077, filed on May 3, 2021.

(51) Int. Cl.

| | |
|---|---|
| ***B61D 7/12*** | (2006.01) |
| ***B61D 7/00*** | (2006.01) |
| ***B61D 7/02*** | (2006.01) |
| ***B61D 7/32*** | (2006.01) |

(52) U.S. Cl.

CPC ..... *B61D 7/12* (2013.01); *B61D 7/00* (2013.01); *B61D 7/02* (2013.01); *B61D 7/32* (2013.01)

(58) Field of Classification Search

CPC . B61D 7/00; B61D 7/02; B61D 17/08; B61D 17/12; B61D 7/12; B61D 7/32

See application file for complete search history.

(56) References Cited

U.S. PATENT DOCUMENTS

| | | | | |
|---|---|---|---|---|
| 1,418,907 | A | 6/1922 | Campbell | |
| 1,444,730 | A | 2/1923 | Christianson | |
| 1,584,436 | A | 5/1926 | Cremean | |
| 1,825,235 | A * | 9/1931 | Kiesel, Jr. | B61D 7/00 105/249 |
| 3,187,684 | A | 6/1965 | Ortner | |
| 3,605,635 | A * | 9/1971 | Stark | B61D 7/00 105/418 |
| 3,608,500 | A | 9/1971 | Floehr | |
| 3,611,947 | A | 10/1971 | Nagy | |
| 3,654,873 | A | 4/1972 | Floehr | |
| 3,786,764 | A | 1/1974 | Beers, Jr. et al. | |
| 3,815,514 | A | 6/1974 | Heap | |
| 3,818,842 | A | 6/1974 | Heap | |
| 3,949,681 | A | 4/1976 | Miller | |
| 4,163,424 | A | 8/1979 | Lindauer | |
| 4,168,665 | A * | 9/1979 | Needham | B61D 17/02 105/418 |

(Continued)

FOREIGN PATENT DOCUMENTS

| | | | | |
|---|---|---|---|---|
| CN | 104908760 A * | 9/2015 | | B61D 7/00 |

*Primary Examiner* — Cheng Lin

(74) *Attorney, Agent, or Firm* — Blynn L. Shideler; Krisanne Shideler; BLK Law Group

(57) ABSTRACT

A covered hopper railcar includes a pair of spaced trucks; a three bay covered hopper railcar body on the pair of trucks; and a partition structure separating each bay from an adjacent bay, wherein each partition structure is extending vertically from sloped floor sheets to a roof structure and extending horizontally between side walls of the railcar body, wherein each partition includes a pair of horizontal ribs.

17 Claims, 7 Drawing Sheets

(56) References Cited

U.S. PATENT DOCUMENTS

| | | | | | |
|---|---|---|---|---|---|
| 4,222,334 | A | | 9/1980 | Peterson | |
| 4,224,877 | A | | 9/1980 | Stark et al. | |
| 4,301,742 | A | * | 11/1981 | Patil | B61D 7/00 105/406.1 |
| 4,366,757 | A | | 1/1983 | Funk | |
| 4,377,058 | A | * | 3/1983 | Hallam | B61D 7/00 52/48 |
| 4,592,693 | A | * | 6/1986 | Perrot | B63B 25/20 280/43.23 |
| 4,601,244 | A | | 7/1986 | Fischer | |
| 5,249,531 | A | | 10/1993 | Taylor | |
| 5,823,118 | A | | 10/1998 | Mangnstrom | |
| 6,164,210 | A | * | 12/2000 | Coslovi | B61D 7/00 105/396 |
| 6,279,217 | B1 | * | 8/2001 | Gallinger | B23K 37/0229 29/559 |
| 6,405,658 | B1 | | 6/2002 | Taylor | |
| 6,502,518 | B1 | * | 1/2003 | Miller | B61D 7/00 105/396 |
| 7,536,957 | B2 | * | 5/2009 | Bush | B61D 7/00 105/247 |
| 7,823,514 | B2 | * | 11/2010 | Forbes | B61D 7/00 105/247 |
| 7,861,659 | B2 | * | 1/2011 | Gillis | B61F 1/02 105/247 |
| 9,272,717 | B2 | | 3/2016 | Forbes et al. | |
| 9,834,230 | B2 | | 12/2017 | Agahi | |
| 10,023,206 | B2 | * | 7/2018 | Bis | B61D 7/28 |
| 10,035,521 | B2 | | 7/2018 | Williams | |
| 10,214,224 | B2 | * | 2/2019 | Forbes | B61D 17/048 |
| 10,315,668 | B2 | | 6/2019 | Early | |
| 10,407,972 | B2 | | 9/2019 | Watson et al. | |
| 10,562,545 | B2 | * | 2/2020 | Gillis | B61D 17/048 |
| 11,142,225 | B2 | * | 10/2021 | Saxton | B61D 7/02 |

* cited by examiner

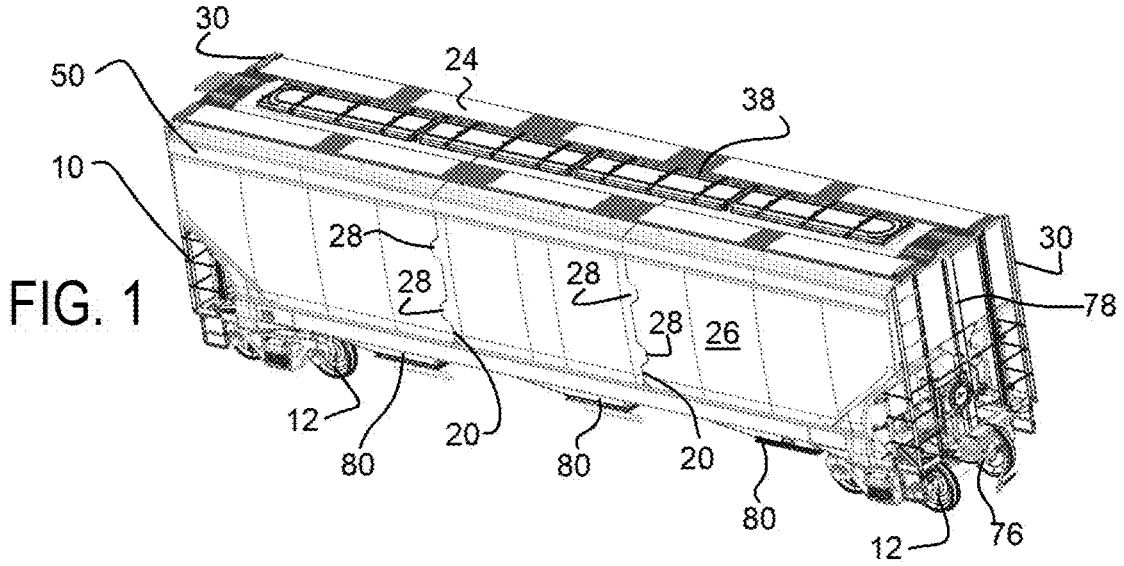
FIG. 1
FIG. 2
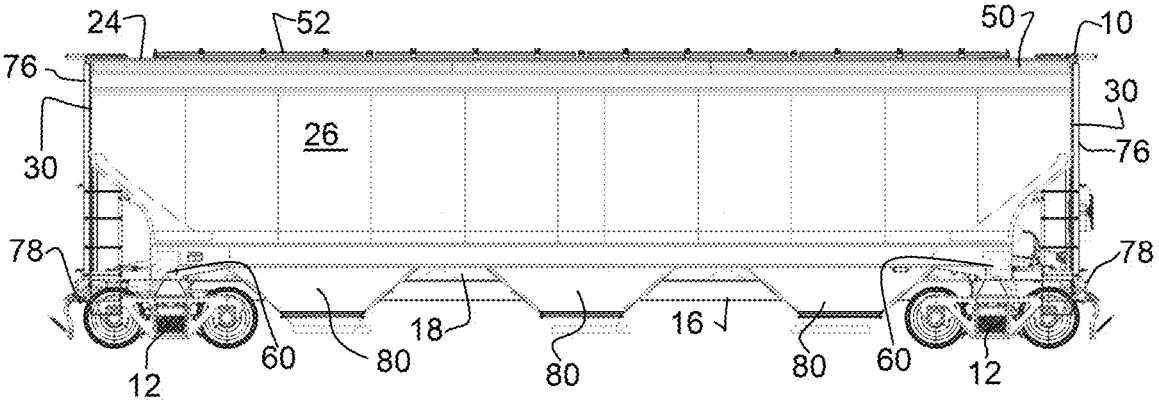
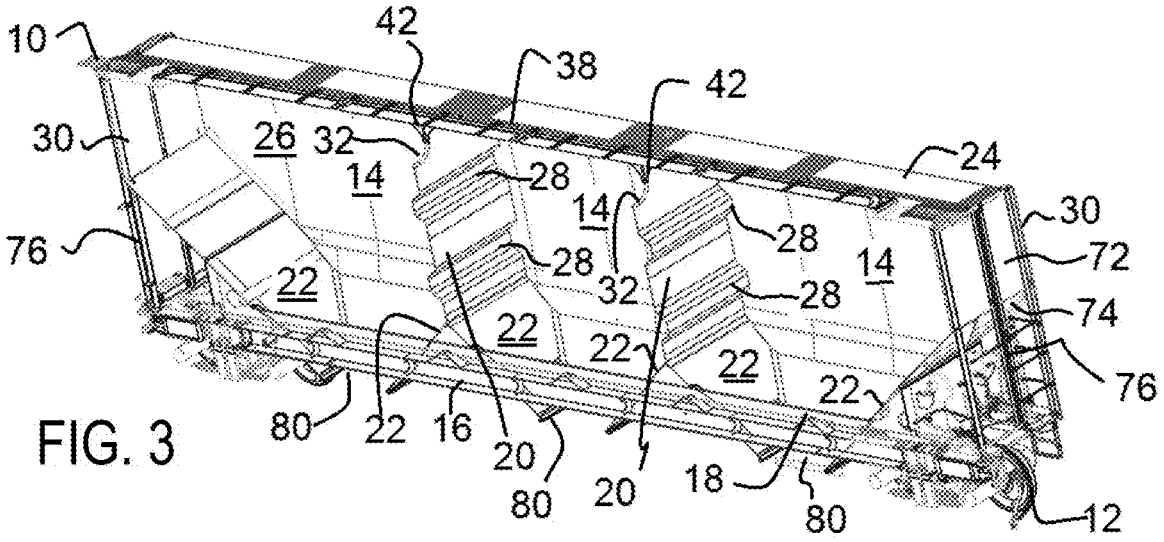
FIG. 3

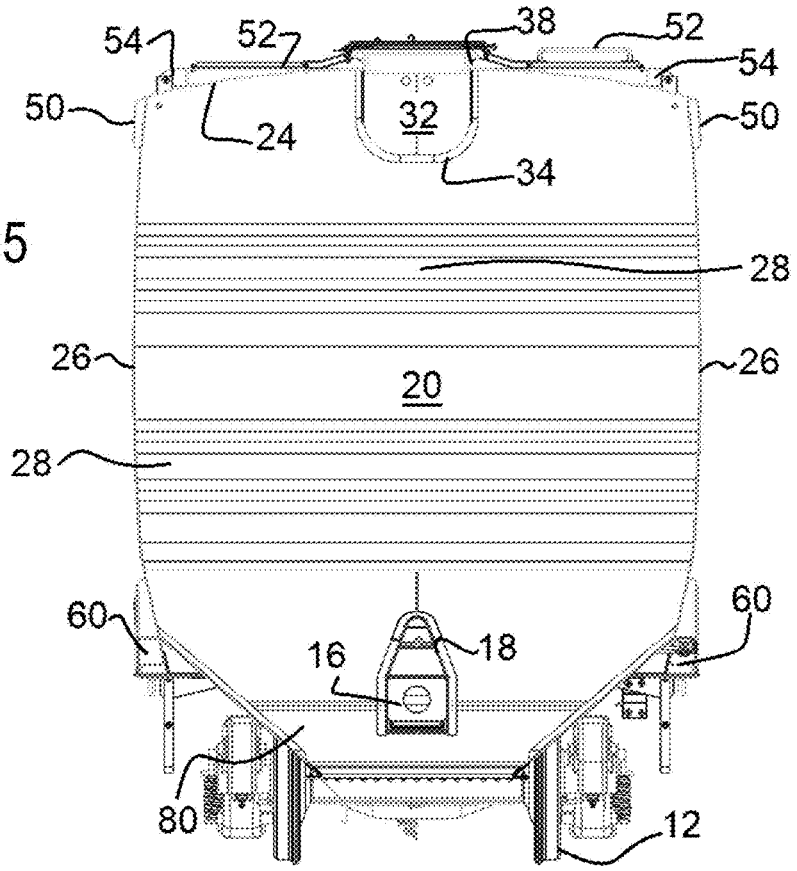
FIG. 5
FIG. 6
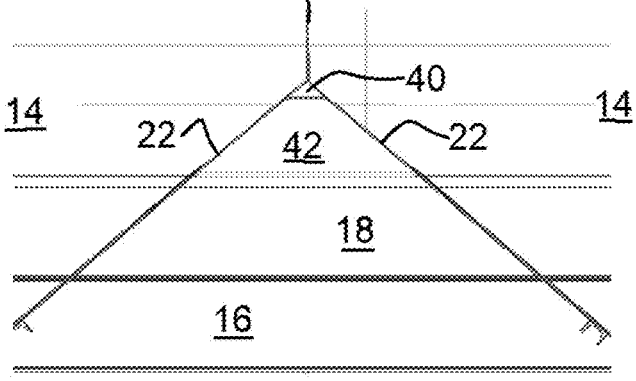
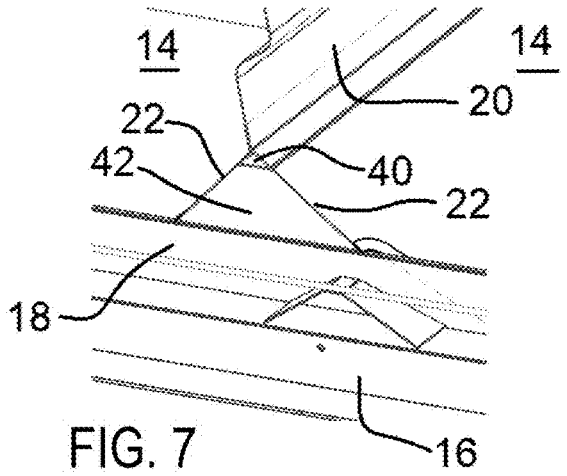
FIG. 7

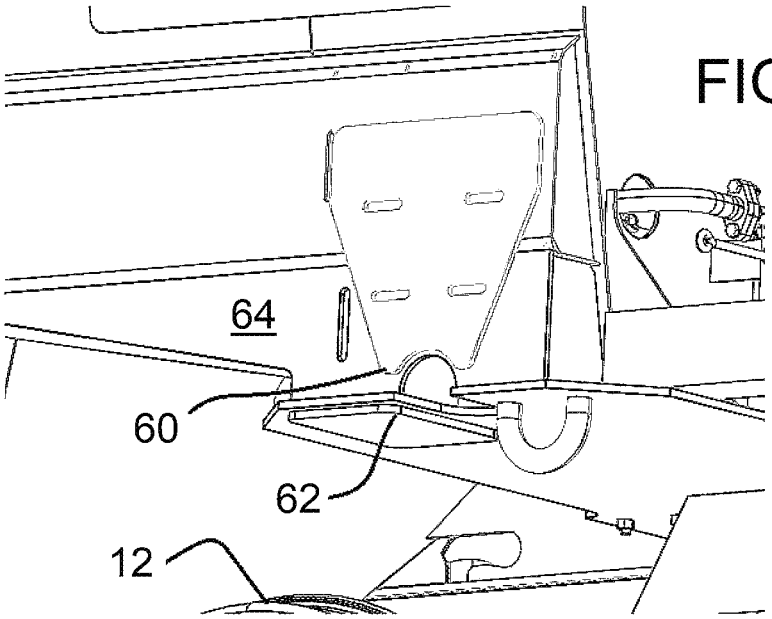
FIG. 12
FIG. 13
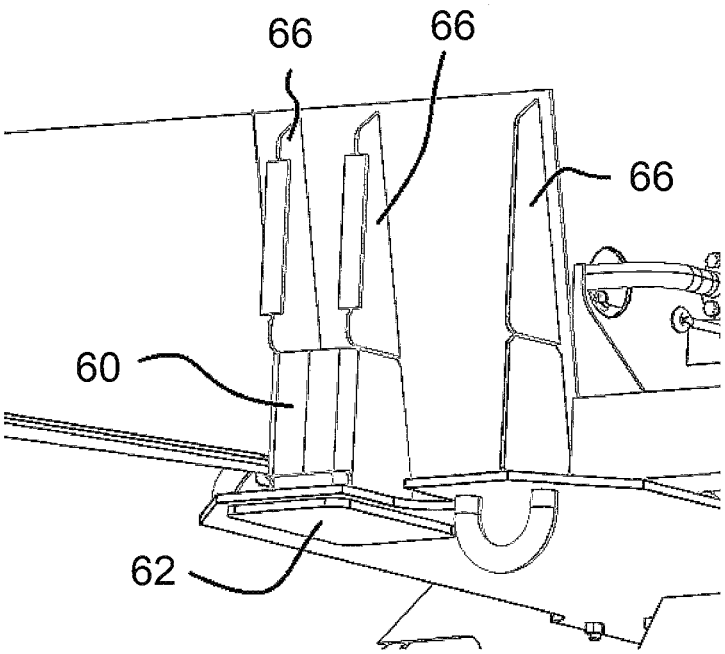

COVERED HOPPER RAILCAR

RELATED APPLICATIONS

This application claims the benefit of U.S. Provisional Patent Application Ser. No. 63/183,077 titled "Covered Hopper Railcar" filed May 3, 2021 which is incorporated herein by reference in its entirety.

BACKGROUND OF THE INVENTION

1. Field of the Invention

The present invention relates generally to a hopper railcar, and in particular, to a three bay covered hopper car.

2. Background Information

A common type of railroad freight car in use today is the type wherein the load may be discharged through hoppers on the underside of the body, which can be generally referred to as a hopper railcar or hopper car. Hopper cars are used to haul coal, grain, and other commodities. Covered hoppers include a top over the hoppers and are often used for transporting dry bulk loads, varying from grain to products such as sand and clay. The cover protects the loads from the weather—for example dry cement would be very hard to unload if mixed with water in transit, while grain would be likely to rot if exposed to rain. After hopper cars are positioned over an unloading pit, the discharge doors of the hoppers are rotated to an open position, allowing the material within the hopper car to be emptied into the pit.

U.S. Pat. No. 10,214,224 discloses a railroad hopper car with a hopper discharge section having a width varying center sill configuration.

U.S. Pat. No. 10,035,521 discloses a railroad hopper car with a plurality of bottom side sheets and a trough assembly coupled to the plurality of bottom side sheets.

U.S. Pat. No. 9,834,230 discloses a railroad hopper car with a shed plate assembly is provided to discourage accumulation of product on the exposed upwardly facing shelf otherwise presented by the bottom flange protrusions.

U.S. Pat. No. 9,272,717 discloses a railroad hopper car

U.S. Pat. No. 10,407,972 discloses a method and mechanism for controlling gravitational discharge of material from a railroad hopper car. U.S. Pat. No. 10,315,668 discloses a hopper gate with multiple openings. U.S. Pat. No. 10,023,206 discloses a hopper car door operating mechanism. U.S. Pat. No. 5,249,531 discloses an effective actuating system for operating the doors of a railroad hopper car in which a plurality of levers for each hopper operate to rotate the doors of the hopper between an open and a closed position. U.S. Pat. No. 6,405,658 effectively discloses a modified individual manual version of the '531 patent. Other prior art references that teach operating mechanisms for opening and closing hopper doors include U.S. Pat. No. 3,187,684; U.S. Pat. No. 3,611,947; U.S. Pat. No. 3,786,764; U.S. Pat. No. 3,815,514; U.S. Pat. No. 3,818,842; U.S. Pat. No. 3,949,681; U.S. Pat. No. 4,222,334; U.S. Pat. No. 4,366,757; U.S. Pat. No. 4,601,244; and U.S. Pat. No. 5,823,118. Further patents of interest include U.S. Pat. Nos. 1,418,907; 1,444,730; 1,584,436; 3,608,500; 3,654,873; 4,163,424; and 4,224,877.

There remains a need for efficient and effective covered hopper railcars.

SUMMARY OF THE INVENTION

One aspect of the invention provides a covered hopper railcar includes a pair of spaced trucks; a three bay covered hopper railcar body on the pair of trucks; and a partition structure separating each bay from an adjacent bay, wherein each partition structure is extending vertically from sloped floor sheets to a roof structure and extending horizontally between side walls of the railcar body, wherein each partition includes a pair of horizontal ribs.

One aspect of the invention provides a covered hopper railcar includes a pair of spaced trucks; a three bay covered hopper railcar body on the pair of trucks; and a partition structure separating each bay from an adjacent bay, wherein each partition structure is extending vertically from sloped floor sheets to a roof structure and extending horizontally between side walls of the railcar body, wherein each partition is coupled to the sloped floor sheets of adjacent bays through a reinforcing triangular member extending between the side walls.

One aspect of the invention provides a covered hopper railcar includes a pair of spaced trucks; a three bay covered hopper railcar body on the pair of trucks; and a partition structure separating each bay from an adjacent bay, wherein each partition structure is extending vertically from sloped floor sheets to a roof structure and extending horizontally between side walls of the railcar body, and a top chord structure which includes an outer top chord member coupled to the side wall of the railcar and to the roof structure, wherein the sidewall extends up to the roof structure and is coupled whereby the top chord member together with an upper portion of the side sheet and outer portion of the roof cover form a closed structure.

These and other advantages of the present invention will be clarified in the following description of the preferred embodiment in which like reference numerals represent like elements throughout.

BRIEF DESCRIPTION OF THE DRAWINGS

FIG. 1 is a schematic perspective view of a covered hopper car according to the present invention.

FIG. 2 is a schematic side elevation view of the covered hopper car of FIG. 1.

FIG. 3 is a schematic perspective longitudinal section view of the covered hopper car of FIG. 1.

FIG. 5 is a sectional end view of a bay partition of the rail car of FIG. 1.

FIG. 6 is an enlarged schematic longitudinal section of sloped floor sheet and partition connection for the railcar of FIG. 1.

FIG. 7 is an enlarged perspective longitudinal section view of sloped floor sheet and partition connection for the railcar of FIG. 1.

FIG. 12 is an enlarged perspective view of the car jacking structure of the railcar of FIG. 1.

FIG. 13 is perspective view of the car jacking structure of FIG. 12 with a front plate removed.

DESCRIPTION OF THE PREFERRED EMBODIMENTS

Figure 4:
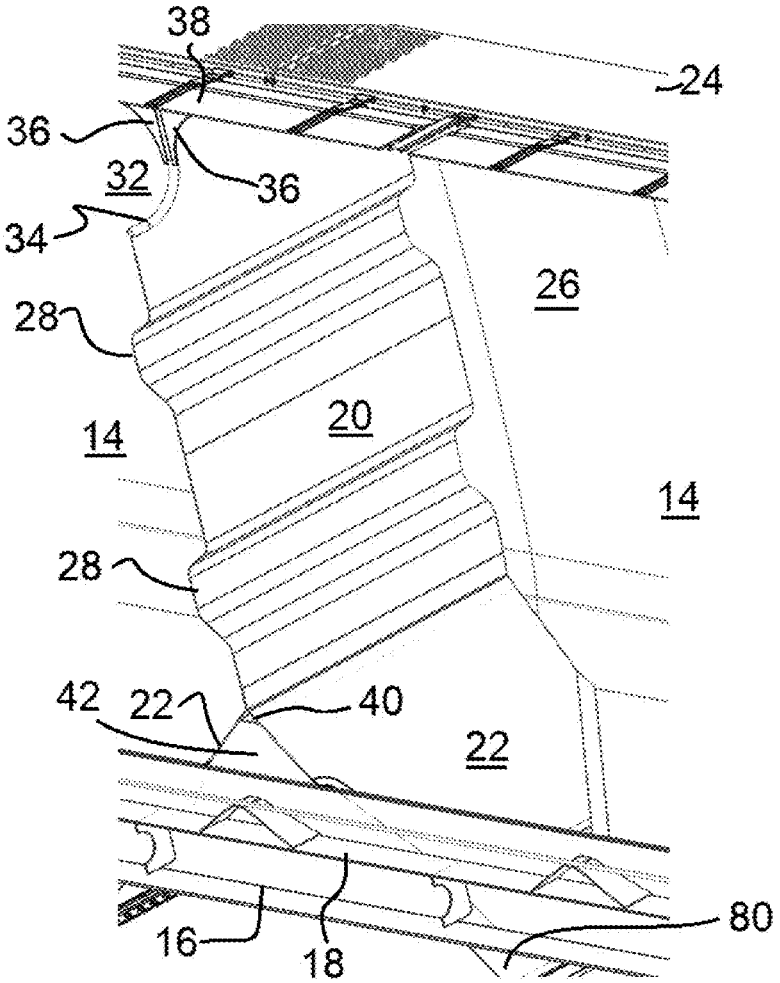
FIG. 4 is an enlarged schematic perspective longitudinal section view of one partition structure of the railcar of FIG. 3.

The construction of a standard covered hopper railcar is well-known in the industry and is described in greater detail in the above cited patents all of which are incorporated herein by reference. FIGS. 1-4 schematically illustrate the covered hopper railcar 10 of the present invention.

The railcar 10 of the present invention includes a railcar body on conventional trucks 12 sitting at 42"7" centers. The length over pulling faces of the car 10 is 55' 1 ½". The car 10 is a three bay 14 covered hopper car with a fabricated center sill 16 and integrated long hood 18. The railcar 10 of the present invention represents the shortest covered hopper having at least a 5450 cubic foot capacity.

PARTITION 20 STRUCTURE

Internally the hopper bays 14 are separated by a partition structure 20, shown in outline in FIG. 1 and in detail in FIGS. 4-5, extending vertically from the sloped floor sheets 22 to the roof structure or roof cover 24 and extending horizontally between the side walls 26. Each partition 20 includes a pair of horizontal ribs 28, one rib 28 above the midline between the sloped floor sheets 22 and the roof cover 24 and one rib 28 below the midline between the sloped floor sheets 22 and the roof cover 24. The ribs 28 each have sloped sides to a recessed base, with the sloped sides allowing flow of particulate into the bay 14 preventing accumulation of lading within the rib 28. The collective or total height of the ribs 28 in the vertical direction is at least 30% of the height of the partition 20 from the sloped floor sheets 22 to the roof cover 24. The ribs 28 at each partition 20 extend toward the closest end 30 of the car 10, in other words the ribs 28 have a base positioned closer to the end 30 of the car 10 than the remainder of the partition 20. This partition 20 construction yields favorable reaction with the side sheets of the side walls 26.

The partition 20 includes a rounded U shaped cutout 32 at the inlet near the roof 24 and a reinforcing piping member 34 around the cutout 32. Gussets 36 are provided on either side of partition 20 at the connection to the roof collar 38 that forms the inlet.

FLOOR SHEET 22 PARTITION 20 INTERFACE STRUCTURE

The lower part of the partition 20 structure, shown in detail in FIGS. 6-7, has a partition 20 forming plate being coupled to the sloped floor sheets 22 of adjacent bays 14 through a reinforcing triangular member 40 extending between the side sheets of the side walls 26. The triangular member 40 is formed by the portions of the sloped floor sheets 22 and the partition structure 20. Specifically the partition 20 forming plate extends down and has a lower sloped portion extending toward one sloped floor sheet 22 and forming one side of the triangular member 40. One sloped floor sheet 22 has a bent horizontal member extending from the end of the lower sloped portion of the partition 20 plate to the other sloped floor sheet 22 and forms the base of the triangular member 40. The other sloped floor sheet 22 as a coupling portion extending from an end of the horizontal member to the partition member and forms the remaining side of the triangular member 40. A frusto-triangular gusset 42 extends from the hood member 18 above the center sill 16 to the floor sheets 22 and to the triangular member 40.

ROOF PLATFORM AND TOP CHORD STRUCTURE

Figure 8:
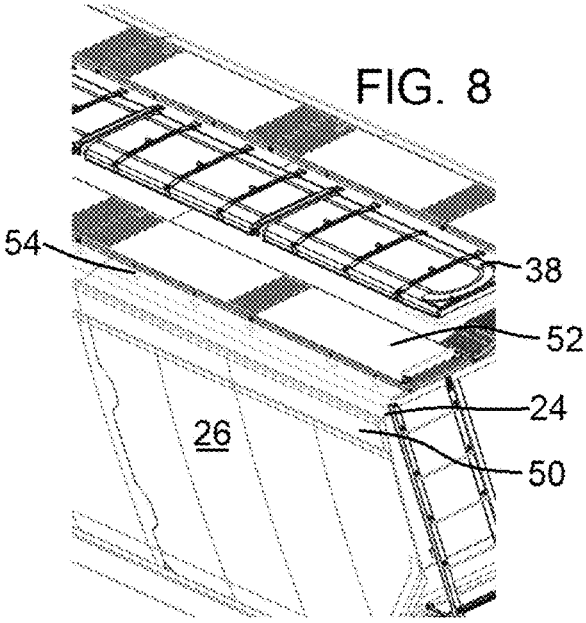
FIG. 8 is a perspective view of the roof and top chord structure of the railcar of FIG. 1.
Figure 9:
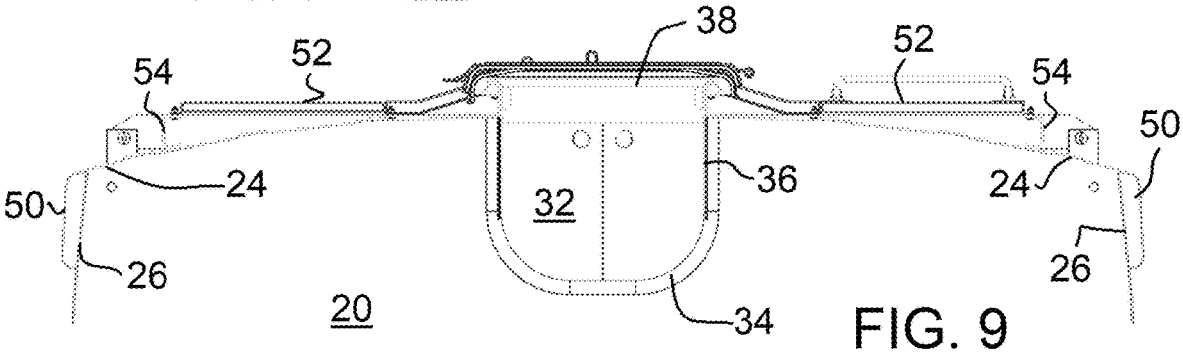
FIG. 9 is a sectional schematic view of the roof and top chord structure of the railcar of FIG. 1.

The top chord 50 structure of the railcar 10 is best illustrated in FIGS. 8-9 and includes an outer top chord member coupling to the side sheets that form the side wall 26 of the railcar 10 and a coupling to the roof cover 24. The sidewalls 26 extend up to the roof cover 24 and are coupled thereto completing what effectively becomes the entire top chord 50 structure. The top chord member together with an upper portion of the side sheet and outer portion of the roof cover 24 form a closed structure that collectively forms the top chord 50 structure for the railcar 10 from a functional and structural standpoint, although the outer top chord member itself can be considered the top chord from a parts standpoint.

The roof 24 structure includes two roof platform members 52 coupled to the roof 24 by a plurality of separate left and right coupling brackets 54. The left and right coupling brackets 54 are separate from each other thereby saving weight in the roof design.

FABRICATED CENTER SILL 16 AND INTEGRATED LONG HOOD 18

Figure 11:
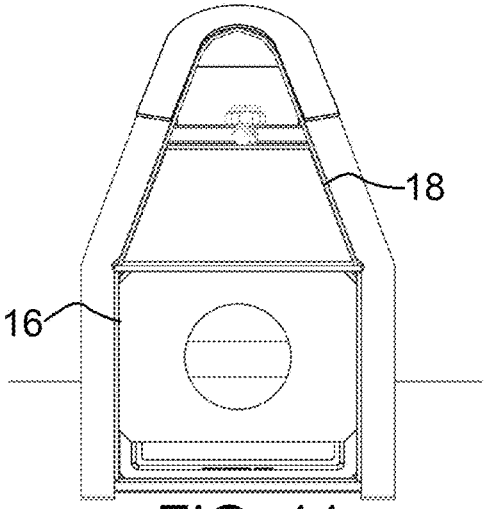
FIG. 11 is a schematic end view of the fabricated center sill and integrated long hood construction of the covered hopper car of FIG. 1.
Figure 10:
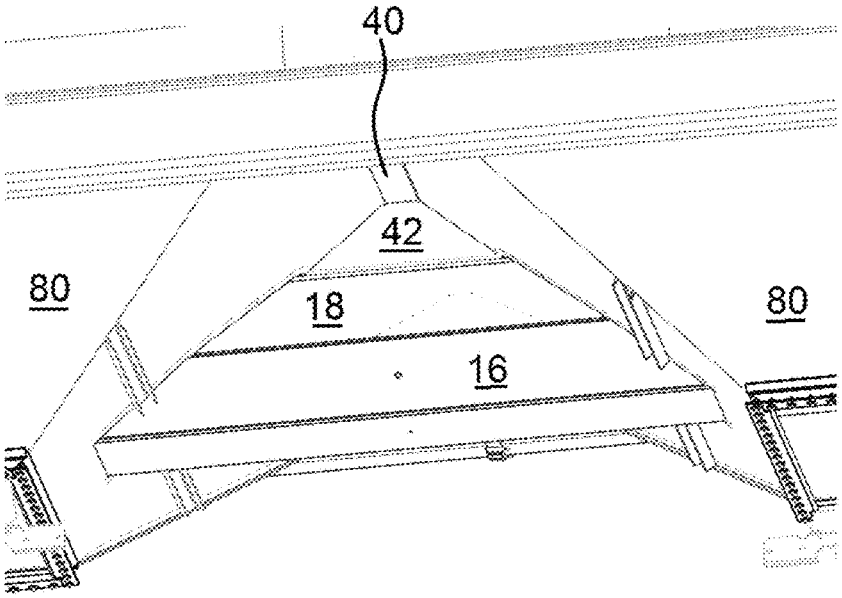
FIG. 10 is a perspective schematic view of the fabricated center sill and integrated long hood construction shown between sloping floor sheets of adjacent bays of the covered hopper car of FIG. 1.

The railcar 10 of the present invention utilizes the fabricated center sill 16 and integrated long hood 18 construction which are best illustrated in FIGS. 10-11. The fabricated center sill 16 includes a base plate, two side plates and a top plate. The center sill 16 forming plates do not need to be of uniform size giving greater flexibility in construction of the center sill 16 than over roll formed structures. The longitudinal hood 18 is formed of a plate having two legs and a rounded top apex with the bottom of each of the two legs welded to outer portions of the top plate of the fabricated center sill 16. This construction allows for simple integration of the hood 18 to the center sill 16 structure.

CAR JACKING STRUCTURE 60

The car-jacking structure 60 of the railcar 10 is shown in FIGS. 12-13 and is shown to extend longitudinally beyond the jacking lift point or plate 62 to yield an improved distribution of forced in use. The jacking structure bottom chord 64 includes a plurality of internal vertical longitudinally spaced diaphragm or web supports 66 shown in FIG. 13.

END 30 CONSTRUCTION

Figure 14:
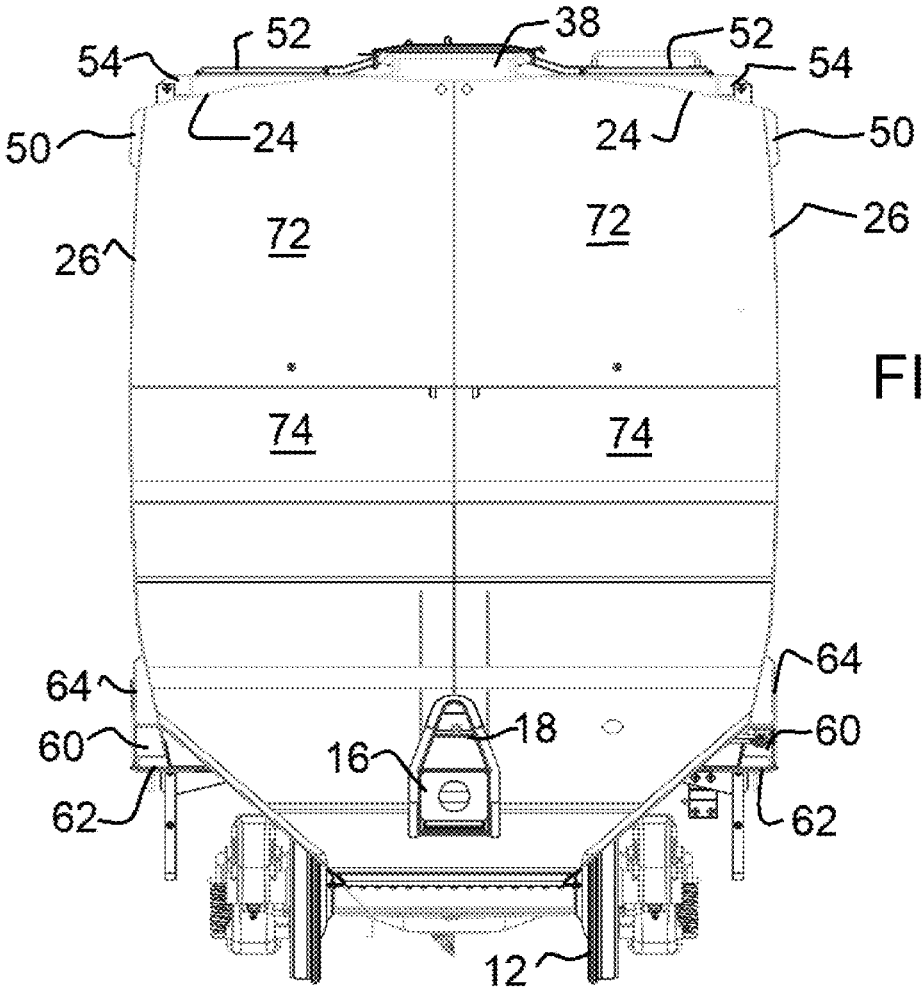
FIG. 14 is an end view of the end wall formation of the present invention.
Figure 15:
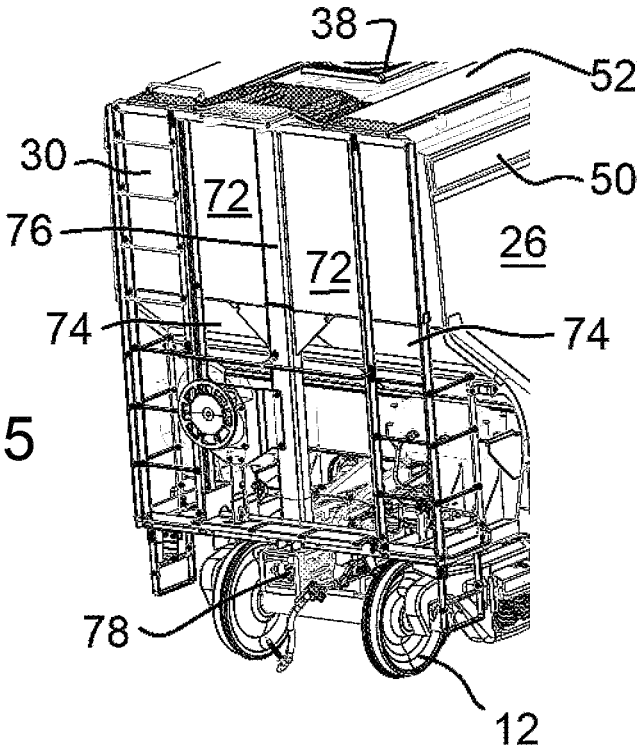
FIG. 15 is a perspective view of the end construction of the railcar according to the present invention.
Figure 16:
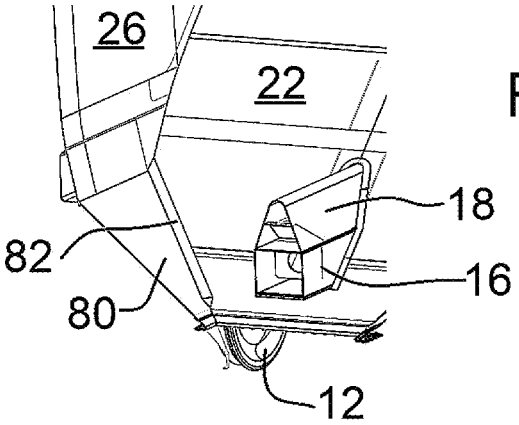
FIG. 16 is a sectional view of the hopper construction of the railcar of the present invention.

FIG. 14 is an end view of the end wall formation of the end 30 of the railcar 10 of the present invention while FIG. 15 is a perspective view of the end 30 construction of the railcar 10 according to the present invention. As shown in FIG. 14 the end wall of the present invention is separated into left and right sides sheets for the end wall construction each divided into upper end wall 72 and lower sloped end floor panels 74. As shown in FIG. 13 the end post is also made of separate upper and lower components. The end wall 30 construction as shown creates flexibility and adjustability in manufacturing allowing for more rapid assembly and reduced stresses. The end post 76 is a closed section at the stub sill 78 to reduce fatigue issues.

HOPPERS 80

The hoppers 80 of the present invention include valley plates 82 at the coupling of adjacent hopper forming floor components to improve stress distribution without adding additional thickness to the slope sheets forming the hoppers 80. Fit up plates are positioned inside of hopper center sill and slope sheet yielding improved fitting time.

SUMMARY

The overall design yields improvements which focuses on reduction in localized stresses, an decrease in length relative to a comparable 5200 cubic foot car while still increasing carrying capacity of the car 10 to at least to 5450 cubic feet while still achieving a weight reduction and cost reduction overall in the car 10 design relative to the comparable 5200 cubic foot covered hopper previously manufactured by the applicant. Total car 10 weight is less than 60,000 lbs, specifically 58,796 lbs.

Whereas particular embodiments of this invention have been described above for purposes of illustration, it will be evident to those skilled in the art that numerous variations of the details of the present invention may be made without departing from the invention as defined in the appended claims. The present invention is not intended to be restricted to the particular embodiments disclosed.

What is claimed is:

1. A railcar comprising:

a pair of spaced trucks;

a three bay covered hopper railcar body on the pair of trucks;

a partition structure separating each bay from an adjacent bay, wherein each partition structure is extending vertically from sloped floor sheets to a roof structure and extending horizontally between side walls of the railcar body, wherein each partition includes a pair of horizontal ribs, and wherein each partition includes a rounded U-shaped cutout at an inlet near the roof and a reinforcing piping member around the cutout with gussets on either side of the partition.

2. The railcar according to claim 1 wherein in each partition one rib is above the midline between the sloped floor sheets and the roof cover and one rib is below the midline between the sloped floor sheets and the roof cover.

3. The railcar according to claim 1 wherein in each partition the ribs each have sloped sides to a recessed base, with the sloped sides allowing flow of particulate into the bay preventing accumulation of lading within the rib.

4. The railcar according to claim 1 wherein a total height of the ribs in the vertical direction is at least 30% of the height of the partition from the sloped floor sheets to the roof cover.

5. The railcar according to claim 1 wherein the ribs at each partition extend toward a closest end of the car.

6. The railcar according to claim 1 wherein each partition is coupled to the sloped floor sheets of adjacent bays through a reinforcing triangular member extending between the side walls.

7. The railcar according to claim 6 wherein the triangular member is formed by the portions of the sloped floor sheets and the partition structure.

8. The railcar according to claim 1 further including a top chord structure which includes an outer top chord member coupled to the side wall of the railcar and to the roof structure, wherein the sidewall extends up to the roof structure and is coupled whereby the top chord member together with an upper portion of the side sheet and outer portion of the roof cover form a closed structure.

9. The railcar according to claim 1 wherein the railcar includes a fabricated center sill and integrated long hood.

10. The railcar according to claim 9 wherein the longitudinal hood 18 is formed of a plate having two legs and a rounded top apex with the bottom of each of the two legs welded to outer portions of a top plate of the fabricated center sill.

11. The railcar according to claim 1 wherein the railcar includes hoppers for each bay which include valley plates at the coupling of adjacent hopper forming floor components.

12. A railcar comprising:

a pair of spaced trucks;

a three bay covered hopper railcar body on the pair of trucks;

a partition structure separating each bay from an adjacent bay, wherein each partition structure is extending vertically from sloped floor sheets to a roof structure and extending horizontally between side walls of the railcar body, wherein each partition includes a pair of horizontal ribs, wherein each partition is coupled to the sloped floor sheets of adjacent bays through a reinforcing triangular member extending between the side walls and further including a gusset extending from a hood member above a center sill to the floor sheets and to the triangular member.

13. A railcar 1 comprising:

a pair of spaced trucks;

a three bay covered hopper railcar body on the pair of trucks;

a partition structure separating each bay from an adjacent bay, wherein each partition structure is extending vertically from sloped floor sheets to a roof structure and extending horizontally between side walls of the railcar body, wherein each partition includes a pair of horizontal ribs, wherein the railcar includes a car-jacking structure having a plate, a jacking structure bottom chord, and a plurality of internal vertical longitudinally spaced web supports.

14. A railcar 1 comprising:

a pair of spaced trucks;

a three bay covered hopper railcar body on the pair of trucks;

a partition structure separating each bay from an adjacent bay, wherein each partition structure is extending vertically from sloped floor sheets to a roof structure and extending horizontally between side walls of the railcar body, wherein each partition includes a pair of horizontal ribs, and wherein the railcar includes an end wall of which is separated into left and right sides sheets, wherein each sheet is divided into an upper end wall and lower sloped end floor panels.

15. The railcar according to claim 14 wherein the railcar includes an end post at each end wherein each end post is also made of separate upper and lower components.

16. A railcar comprising:

a pair of spaced trucks;

a three bay covered hopper railcar body on the pair of trucks;

a partition structure separating each bay from an adjacent bay, wherein each partition structure is extending vertically from sloped floor sheets to a roof structure and extending horizontally between side walls of the railcar body, wherein each partition is coupled to the sloped floor sheets of adjacent bays through a reinforcing triangular member extending between the side walls and further including a gusset extending from a hood member above a center sill to the floor sheets and to the triangular member.

17. The railcar according to claim 16 wherein the triangular member is formed by the portions of the sloped floor sheets and the partition structure.

* * * * *